United States Patent [19]

Anno et al.

[11] Patent Number: 4,686,943

[45] Date of Patent: Aug. 18, 1987

[54] CLOSED-DECK CYLINDER BLOCK FOR WATER-COOLED INTERNAL COMBUSTION ENGINES

[75] Inventors: Nobuo Anno; Takeo Arai, both of Saitama, Japan

[73] Assignee: Honda Giken Kogyo Kabushiki Kaisha, Tokyo, Japan

[21] Appl. No.: 804,296

[22] Filed: Dec. 3, 1985

[30] Foreign Application Priority Data

Dec. 3, 1984 [JP] Japan ..... 59-255299
Dec. 6, 1984 [JP] Japan ..... 59-258152

[51] Int. Cl.[4] ..... F01P 3/02
[52] U.S. Cl. ..... 123/41.74
[58] Field of Search ..... 123/41.72, 41.74, 195 R

[56] References Cited

U.S. PATENT DOCUMENTS 2,951,472 9/1960 Skubic ..... 123/41.72
4,470,376 9/1984 Hayashi ..... 123/41.74

*Primary Examiner*—William A. Cuchlinski, Jr.
*Attorney, Agent, or Firm*—Lyon & Lyon

[57] ABSTRACT

A closed-deck cylinder block of a light alloy such as an aluminum alloy for use in a water-cooled internal combustion engine includes a cylinder-defining portion having a plurality of cylinder bores defined therein, and a crankcase-defining portion integral with the cylinder-defining portion. The cylinder-defining portion includes a water jacket extending substantially the entire length of each of the cylinder bores and defined by an inner side wall, and outer side wall spaced therefrom, and a bottom wall interconnecting the inner and outer side walls. The bottom wall has a wall thickness substantially equal to at least one of the wall thicknesses of the inner and outer side walls. The wall thicknesses of the inner and outer side walls are substantially equal to each other.

8 Claims, 2 Drawing Figures

CLOSED-DECK CYLINDER BLOCK FOR WATER-COOLED INTERNAL COMBUSTION ENGINES

The present invention relates to a closed-deck cylinder block for use in an automotive water-cooled internal combustion engine.

Cylinder blocks for water-cooled internal combustion engines are generally classified into open-deck cylinder blocks and closed-deck cylinder blocks. In the open-deck cylinder blocks, the water jacket for cooling primarily the cylinder-defining portions of the cylinder block has its upper end open substantially entirely at the upper surface, or the deck, of the cylinder block. In the closed-deck cylinder blocks, the upper end of the water jacket is substantially closed with only water passages open at the deck for communication with a cylinder head.

The closed-deck cylinder blocks for water-cooled internal combustion engines are well known in the art. It is also known to construct such cylinder blocks of a light alloy. See for example Japanese Utility Model Publication No.59 (1984)-13319 and Japanese Laid-Open Patent Publication No. 58 (1983)-74851.

The closed-deck cylinder blocks are suitable for use in automotive multicylinder engines of a high power output capability since the deck serving as a surface for attachment to the cylinder head is of high rigidity and the durability of the gasket inserted between the cylinder block and the cylinder head is increased. However, many difficulties have been experienced in casting the closed-deck cylinder blocks. Particularly, it is highly difficult and costly, even if possible, to cast such a closed-deck cylinder block of an aluminum alloy. For this reason, most conventionally available cylinder blocks made of a light alloy for use in multicylinder internal combustion engines have been open-deck cylinder blocks which are relatively easy to cast. The open-deck cylinder blocks can be mass-produced at a low cost because they can be cast by a conventional die-casting process. One problem with the prior die-casting process is that a desired water jacket may not be obtained because it is formed by a mold which imposes a limitation on the shape and depth of the water jacket. The water jacket with such design limitations will not efficiently cool the cylinder block and will be an obstacle to efforts to achieve a higher engine output.

A new casting process has been developed, as disclosed in U.S. Pat. Nos. 4,436,140 and 4,519,436 assigned to the present assignee, that is suitable for casting closed-deck cylinder blocks of a light alloy of the type of the present invention.

It is an object of the present invention to provide a closed-deck cylinder block which can be cast by a pressure casting process, can efficiently and evenly be water-cooled for a uniform temperature distribution, and is free from casting defects or cavities.

According to the present invention, there is provided a closed-deck cylinder block of a light alloy for use in a water-cooled internal combustion engine, including a cylinder-defining portion having a plurality of cylinder bores defined therein, and a crankcase-defining portion integral with the cylinder-defining portion. The cylinder-defining portion includes a water jacket extending substantially the entire length of each of the cylinder bores and defined by an inner side wall, an outer side wall spaced therefrom, and a bottom wall interconnecting the inner and outer side walls. The bottom wall has a wall thickness substantially equal to at least one of the wall thicknesses of the inner and outer side walls. The wall thicknesses of the inner and outer side walls are substantially equal to each other.

The water jacket thus constructed is effective in cooling the cylinder bores highly efficiently and evenly in their entirety through a uniform temperature distribution in the cylinder-defining portion whereby the engine performance is improved. Since the molten metal of the water jacket walls will solidify at equal speeds when the cylinder block is cast, due to substantially equal wall thicknesses, the cylinder-defining portion is free from casting defects or cavities.

The above and other objects, features and advantages of the present invention will become more apparent from the following description when taken in conjunction with the accompanying drawings in which a preferred embodiment of the present invention is shown by way of illustrative example.

The present invention will be described as being applied to a closed-deck cylinder block for use in an in-line four-cylinder internal combustion engine but it will be understood by those skilled in the art that the invention is equally applicable to other types and sizes of engines.

Figure 1:
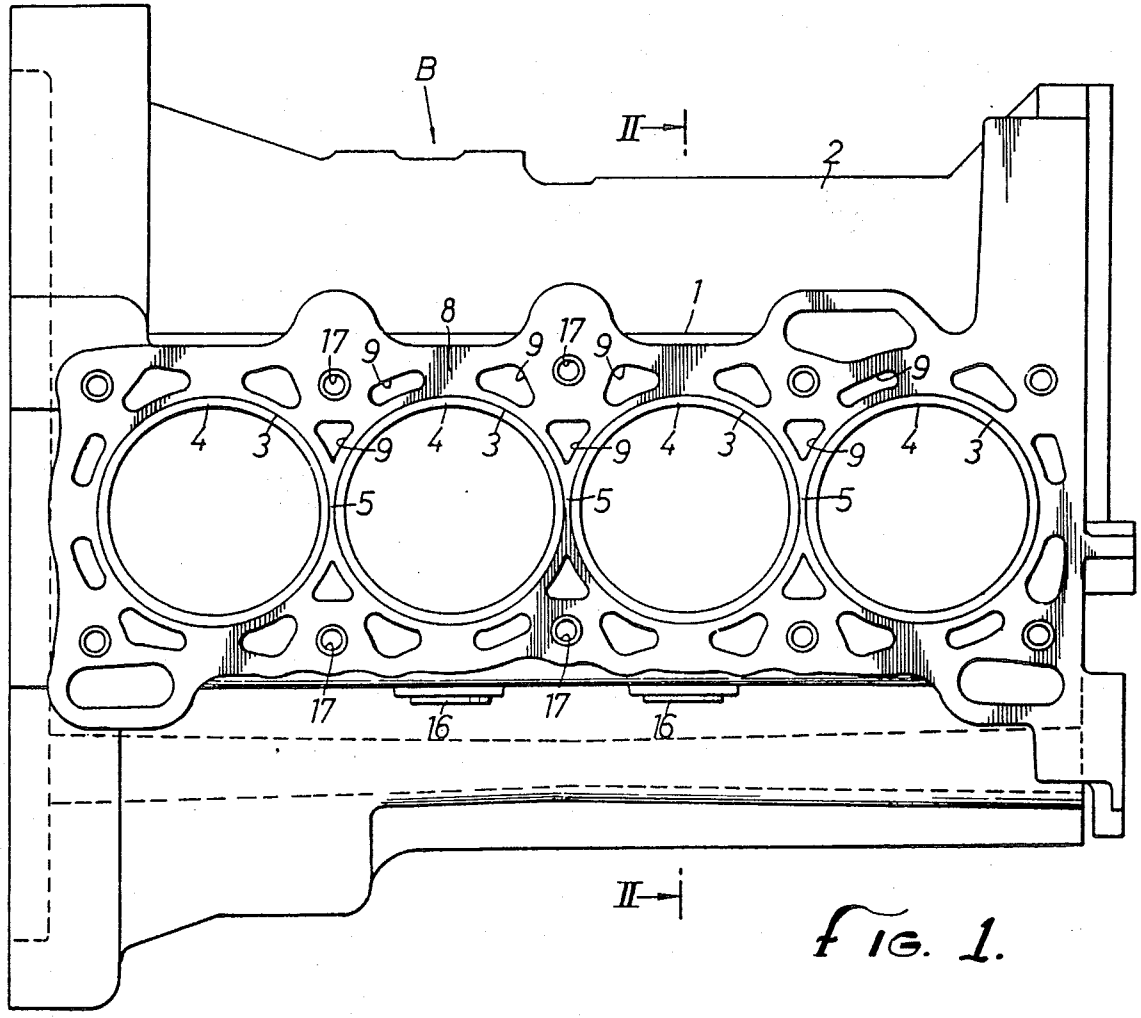
FIG. 1 is a plan view of a cylinder block according to the present invention.
Figure 2:
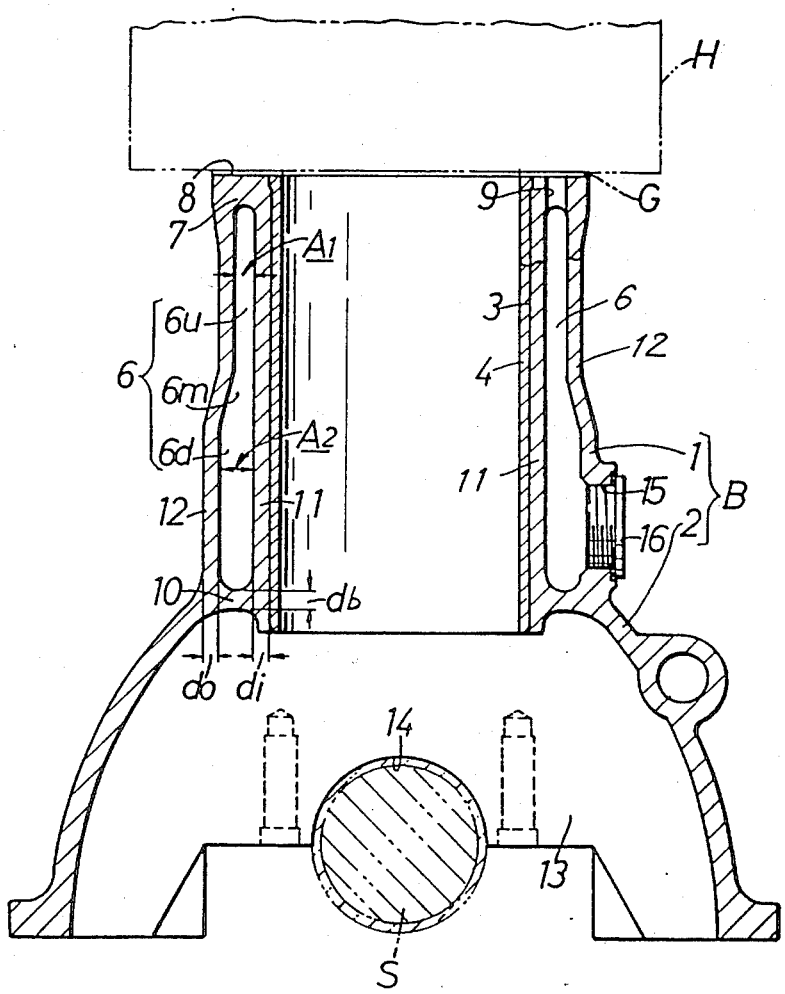
FIG. 2 is cross-sectional view taken substantially along the line II—II of FIG. 1.

As shown in FIGS. 1 and 2, a closed-deck cylinder block B, cast of an aluminum alloy by the pressure casting process developed by the assignee of this application, generally comprises an upper cylinder-defining portion 1 and a lower crankcase defining portion 2 which are integral with each other. The cylinder-defining portion 1 has four cylinder bores 3 arranged in line in the so-called Siamese configuration with no water jackets in the common boundary walls 5 between the adjacent cylinder bores 3.

Cylinder liners 4 are fitted respectively in the cylinder bores 3 and have lower ends projecting slightly into the lower crankcase-defining portion 2.

The cylinder-defining portion 1 has a water jacket 6 defined therein in surrounding relation to the respective cylinder bores 3, except at the boundary walls 5 between the adjacent cylinder bores 3. As shown in FIG. 2, the water jacket 6 extends substantially the entire length of each of the cylinder bores 3. The water jacket 6 includes an upper portion **6*u* having a cross-sectional area $A_1$ with a narrow width shown by the arrows and a lower portion 6*d* having a cross-sectional area $A_2$ with a wider width shown by the arrows. The cross-sectional area $A_1$ is smaller than the cross-sectional area $A_2$ and therefore, the volume of the upper portion 6*u* for storing cooling water is smaller than that of the lower portion 6*d*. The upper and lower portions 6*u* and 6*d* are smoothly connected to each other through an intermediate portion 6*m* flaring progressively downwardly from the upper portion 6*u* and 6*d*** without being subject to any appreciable resistance.

The closed-deck cylinder block B has an upper wall 7 of a prescribed wall thickness extending over the water jacket 6, the upper wall 7 having an upper surface serving as a deck 8 to which a cylinder head H is to be coupled. The upper wall 7 has a plurality of small water passages 9 defined therein and through which the water jacket 6 opens at the deck 8. The cylinder head H is coupled to the cylinder block B with a gasket G interposed therebetween and the water jacket 6 communicates through the water passage 9 with the water jacket (not shown) in the cylinder head H.

The water jacket 6 is transversely defined between an inner side wall 11 having a wall thickness di and an outer side wall 12 spaced therefrom and having a wall thickness do, as illustrated in FIG. 2, the wall thicknesses di and do being substantially equal to each other. The water jacket 6 has a bottom wall 10 interconnecting the inner and outer side walls 11 and 12 and bottom wall 10 has a wall thickness db which is substantially the same as each of the wall thicknesses di and do. Each of these wall thicknesses db, di and do preferably have a tolerance within 10%. Alternatively, the wall thickness db may be equal to at least one of the wall thicknesses di and do.

The crankcase-defining portion 2 has a plurality of integral journal walls 13 (only one shown in FIG. 2) spaced at intervals along the direction in which the cylinder bores 3 are arranged in line. Each of the journal walls 13 has a semicircular bearing recess 14 defined centrally in its lower edge and opening downwardly for receiving a crankshaft S.

The water jacket 6 is formed by a core in the form of a sand mold when the cylinder block B is cast. The outer wall 12 shown on the righthand side in FIG. 2 has a hole 15 for supporting the core through a mold (not shown) and removing the core therethrough after the cylinder block B has been cast. The hold 15 is closed off a blind plug 16 after the core has been removed.

The cylinder head H can be fixed to the cylinder block B by bolts (not shown) threaded into bolt holes 17 (FIG. 1) defined in the deck 8.

When the internal combustion engine incorporating the closed-deck cylinder block B thus constructed is in operation, the cooling water supplied from a radiator (not shown) flows into the water jacket 6 to cool mainly the cylinder-defining portion 1 of the cylinder block B. Since the water jacket 6 extends substantially the entire length of each of the cylinder bores 3 and the wall thickness db of the bottom wall 10 is substantially equal to the wall thicknesses di and do of the inner and outer side walls 11 and 12 of the water jacket 6, the temperature distribution of the cylinder-defining portion 1 is substantially uniform to water-cool the entire cylinder bores 3 substantially evenly. Therefore, the cylinder block B is cooled much more efficiently, and the engine performance is improved.

When the cylinder block B is cast, the molten metal of the cylinder-defining portion 1 is solidified at substantially equal speeds in the water jacket walls because of the substantially same wall thicknesses thereof. Consequently, the cylinder-defining portion 1 is free from casting defects or cavities which would otherwise be present in the inner and outer side walls 11 and 12.

Although a certain preferred embodiment has been shown and described, it should be understood that many changes and modifications may be made therein without departing from the scope of the appended claims.

What is claimed:

1. A closed-deck cylinder block of a light alloy for use in a water-cooled internal combustion engine, comprising:

an integrally cast block having a cylinder-defining portion and a crankcase-defining portion;

said cylinder-defining portion having a plurality of cylinder bores defined therein;

said cylinder-defining portion including a water jacket extending substantially the entire length of each of said cylinder bores and defined by an inner side wall, an outer side wall spaced therefrom, an upper wall interconnecting at least substantial portions of upper ends of said inner and outer side walls forming a closed-deck construction, and a bottom wall interconnecting said inner and outer side walls, said bottom wall having a wall thickness substantially equal to at least one of the wall thicknesses of said inner and outer side walls.

2. A closed-deck cylinder block according to claim 1 wherein said water jacket includes an upper portion having a first cross-sectional area, a lower portion having a second cross-sectional area, said first cross-sectional area being smaller than said second cross-sectional area, and an intermediate portion defined between said upper and lower portions and flaring downwardly and outwardly from said upper portion toward said lower portion.

3. A closed-deck cylinder block according to claim 1 wherein said inner and outer side walls have substantially equal wall thicknesses.

4. A closed-deck cylinder block according to claim 2 wherein said inner and outer side walls have substantially equal wall thicknesses.

5. A closed-deck cylinder block according to claim 1 wherein said water jacket includes an upper portion and a lower portion with said upper portion having said inner and outer side walls spaced closer together than in said lower portion.

6. A closed-deck cylinder block of a light alloy for use in a water-cooled internal combustion engine, comprising:

an integrally cast block having a cylinder-defining portion and a crankcase-defining portion;

the cylinder-defining portion having a plurality of cylinder bores defined therein; and said cylinder-defining portion including a water jacket extending substantially the entire length of each of said cylinder bores and defined by an inner side wall, an outer side wall spaced therefrom, an upper wall interconnecting at least substantial portions of upper ends of said inner and outer side walls forming a closed-deck construction, and a bottom wall interconnecting said inner and outer side walls, said inner and outer side walls having respective wall thicknesses which are substantially equal to each other.

7. A closed-deck cylinder block according to claim 6 wherein said water jacket includes an upper portion having a first cross-sectional area, a lower portion having a second cross-sectional area, said first cross-sectional area being smaller than said second cross-sectional area, and an intermediate portion defined between said upper and lower portions and flaring downwardly from said upper portion toward said lower portion.

8. A closed-deck cylinder block integrally cast of a light alloy for use in a water-cooled internal combustion engine, comprising, a cylinder-defining portion having a plurality of cylinder bores defined therein and including a water jacket extending substantially the entire length of each of said cylinder bores, said water jacket having inner and outer side walls and a bottom wall interconnecting said inner and outer side walls with said side and bottom walls having substantially equal wall thicknesses, an upper wall interconnecting portions of upper ends of the inner and outer side walls forming a closed-deck construction, and said water jacket having upper and lower portions with said upper portion having said side walls spaced closer together than said lower portion.

* * * * *